US008264433B2

(12) United States Patent
Nakai et al.

(10) Patent No.: US 8,264,433 B2
(45) Date of Patent: Sep. 11, 2012

(54) DISPLAY APPARATUS

(75) Inventors: Yutaka Nakai, Yokohama (JP); Tsuyoshi Hioki, Yokohama (JP)

(73) Assignee: Kabushiki Kaisha Toshiba, Minato-ku, Tokyo (JP)

( * ) Notice: Subject to any disclaimer, the term of this patent is extended or adjusted under 35 U.S.C. 154(b) by 829 days.

(21) Appl. No.: 12/408,886

(22) Filed: Mar. 23, 2009

(65) Prior Publication Data

US 2009/0243980 A1 Oct. 1, 2009

(30) Foreign Application Priority Data

Mar. 28, 2008 (JP) ..... 2008-086156

(51) Int. Cl.
*G09G 3/34* (2006.01)

(52) U.S. Cl. ..... 345/84

(58) Field of Classification Search ..... 345/84–86, 345/204

See application file for complete search history.

(56) References Cited

U.S. PATENT DOCUMENTS

| | | | | |
|---|---|---|---|---|
| 6,490,402 | B1 * | 12/2002 | Ota | 385/147 |
| 2005/0191020 | A1 * | 9/2005 | Katase | 385/129 |
| 2005/0231680 | A1 | 10/2005 | Hioki et al. | |

FOREIGN PATENT DOCUMENTS

| | | | |
|---|---|---|---|
| JP | 55-26544 | A | 2/1980 |
| JP | 1-302396 | A | 12/1989 |
| JP | 4-278985 | A | 10/1992 |
| JP | 10-78761 | A | 3/1998 |
| JP | 11-73142 | A | 3/1999 |
| JP | 2001-265265 | A | 9/2001 |
| JP | 2001-282140 | A | 10/2001 |
| JP | 2002-244578 | A | 8/2002 |
| JP | 2003-525463 | A | 8/2003 |
| JP | 2004-226709 | A | 8/2004 |
| JP | 2005221590 | | 8/2005 |
| JP | 2005308904 | | 11/2005 |
| JP | 2006-208769 | A | 8/2006 |

OTHER PUBLICATIONS

Japanese Search Report dated May 8, 2012 from JP 2008-086156 (7 pages, with English translation).

* cited by examiner

*Primary Examiner* — Jimmy H Nguyen
(74) *Attorney, Agent, or Firm* — Ohlandt, Greeley, Ruggiero & Perle, L.L.P.

(57) ABSTRACT

A display apparatus includes a display part in which a plurality of light guide elements are extended in the column direction, and are arranged in the row direction in parallel with each other. A plurality of scanning lines are extended in the row direction to intersect the light guide elements, arranged in the column direction, transmission lines are extended along the light guide elements, and each of the transmission lines is connected to the scanning lines, respectively. Control elements are provided at intersections of the light guide elements and the scanning lines, and each of the control elements causes a part of a light beam traveled in the light guide element to the outside of the light guide element in response to a scanning signal supplied to the scanning line through the transmission line.

9 Claims, 8 Drawing Sheets

DISPLAY APPARATUS

CROSS-REFERENCE TO RELATED APPLICATIONS

This application is based upon and claims the benefit of priority from prior Japanese Patent Application No. 2008-086156, filed Mar. 28, 2008, the entire contents of which are incorporated herein by reference.

BACKGROUND OF THE INVENTION

1. Field of the Invention

The present invention relates to a display apparatus for displaying an image on a display surface in which light guide elements are arranged in parallel with each other.

2. Description of the Related Art

In recent years, a liquid crystal display, plasma display, and various display devices have been developed as a display module for a display apparatus. The demand for these display devices is now increasing concomitantly with the start of the terrestrial digital media broadcasting, and the popularization of the Internet and cellular phone. Further, as for these displays, development of a large-sized display corresponding to a large-screen TV is demanded in addition to a small-sized display to be mounted on a mobile device, and the demand for the large-screen display is also increasing.

In the conventional display, matrix wiring is provided on a glass substrate and, particularly in the liquid crystal display, a thin film transistor is provided at an intersection point of the matrix wiring. In the thin film processing, a semiconductor manufacturing process is used. Accordingly, in order to meet the demand for upsizing of the display, a large-sized equipment capable of performing a semiconductor manufacturing process on a large glass substrate is required, and hence a problem is caused that the amount of investment in the production line becomes enormous. Further, in the formation of the matrix wiring based on the thin film process, the wiring resistance becomes large concomitantly with the upsizing, and thus in a large-screen display, a signal delay resulting from the wiring resistance becomes a problem.

As a method of solving these problems, as disclosed in JP-A 2005-221590 (KOKAI), a display using light guide elements is proposed. In this display, a plurality of elongated light guide elements such as optical fibers are prepared, arranged in parallel with each other on a flat surface, and a front surface of the light guide elements of the parallel arrangement makes the display surface. Light beams from light sources are introduced from the end faces of the light guide elements arranged in parallel with each other into the light guide elements, guided in the light guide elements, and the light beams are extracted from arbitrary positions on the light guide elements so as to form light spot. In a display provided with a display surface in which light guide elements are arranged in parallel with each other, an image is displayed as a formation of a plurality of light spots from which the light beam is taken out.

In a display apparatus having such a structure, it is also possible to separate the light sources from the display surface, and select adequate light sources having a high efficiency. Further, if the light guide element is constituted of an optical fiber, there is an advantage that it is possible to realize a flexible display utilizing the flexibility of the optical fiber. In an example, there are prepared a plurality of displays each having a display surface in which light guide elements are arranged in parallel with each other, and it is also possible to realize a large-screen display by tiling a wall surface using the plural displays.

In a display apparatus for displaying an image on a display surface in which light guide elements are arranged in parallel with each other, a plurality of scanning lines are arranged in parallel with each other to intersect the light guide elements of the parallel arrangement, light sources, and a drive circuit for driving the light sources are arranged on one side of the display as to be opposed to the end faces of the light guide elements, and a scanning signal generation module for supplying a scanning signal to the scanning lines is arranged on the other side of the display in the extension direction of the light guide elements. That is, in the same manner as the conventional liquid crystal display, or a plasma display, a light source and a light source drive module are arranged on one side of a display having a rectangular shape, and a scanning signal generation module is arranged on the other side of the display intersecting the one side thereof.

Accordingly, in the display apparatus having such a structure, if the display surfaces are juxtaposed, a scanning signal generation module is inevitably provided between displays, and hence there is a problem that a non-display area in which no image is displayed is formed between displays. That is, when displays are arranged in a tiling manner to realize a big-screen display apparatus, there is a problem that dead spaces are formed at joints between displays, and the image quality is significantly deteriorated.

Further, although the display has flexibility, the scanning signal generation modules around the display are each constituted of a circuit board, and have no flexibility, thereby posing a problem that the apparatus cannot be deformed into a compact size and stored in a small space with utilizing the flexibility of the display.

From such a background, although the display in which the light guide elements are arranged in parallel with each other latently has the excellent features of the flexibility, and the possibility of upsizing of the display screen, there is a problem in the display apparatus for displaying an image that the features cannot be fully exhibited.

Accordingly, in the display apparatus having such a structure, there is the problem that if the display surfaces are juxtaposed, scanning signal generation modules are inevitably arranged between the display surfaces, and non-display areas in which no images are displayed are formed between the display surfaces.

BRIEF SUMMARY OF THE INVENTION

According to an aspect of the present invention, there is provided a display apparatus comprising:

a display part including a plurality of light guide elements which have end faces, are extended in the column direction, and are arranged in the row direction in parallel with each other;

emitting parts which emits light beams which are directed to the end faces and are introduced into the light guide elements, respectively;

scanning lines extended in the row direction, arranged in the column direction, and intersecting with the light guide elements;

a generation module which generates scanning signals to the scanning lines;

a control unit which controls the emitting parts to control emissions of the light beams from the emitting parts into the light guide elements;

control elements provided at intersections of the light guide elements and the scanning lines, each of which causes a part of the light beam traveled in the light guide element to the outside of the light guide element in response to the scanning signal applied to the control element through the scanning line; and first transmission lines extended along the light guide elements, which connect the scanning lines to the generation module to supply the scanning signals to the scanning lines from the generation module, respectively.

DETAILED DESCRIPTION OF THE INVENTION

A display apparatus according to an embodiment of the present invention will be described below with reference to the accompanying drawings.

Figure 1:
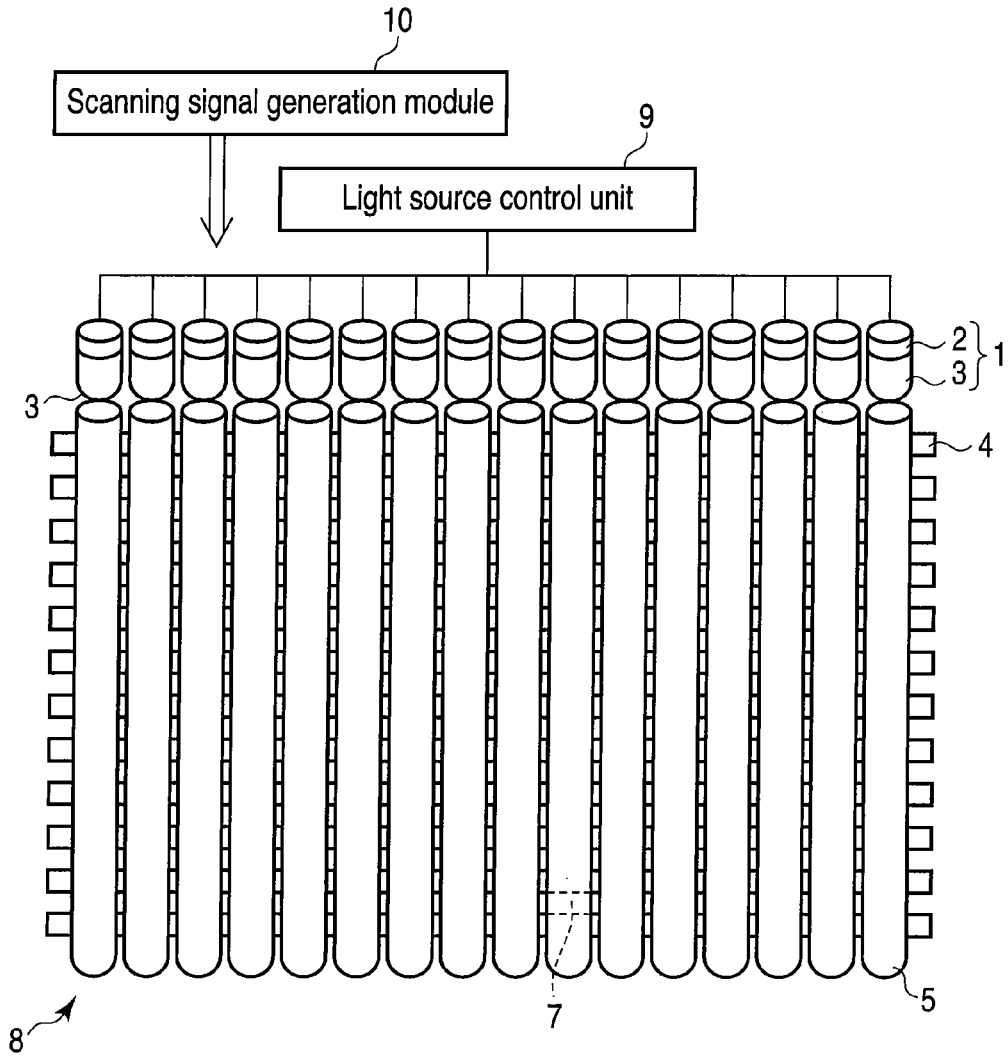
FIG. 1 is a block diagram schematically showing a display apparatus according to an embodiment of the present invention.

FIG. 1 schematically shows the display apparatus and peripheral circuits for causing the display to display an image according to one embodiment of the present invention.

As shown in FIG. 1, a large number of light guide elements 5 having flexibility, for example, elongated light guides such as optical fibers having flexibility are extended in the column direction, and the large number of light guide elements 5 are arranged in parallel with each other in the row direction, thereby forming a display surface 8 of the display apparatus. At the back side of the display surface 8 of the light guide elements 5, a plurality of scanning lines 4 are extended in the row direction to intersect the light guide elements 5 arranged in parallel with each other in the row direction preferably substantially at right angles, and are arranged in the column direction. Optical control elements (not shown in FIG. 1) leading the light beams from the light guide elements 5 to the display surface side (front side of the display surface) are provided at intersections 7 of the scanning lines 4 and the light guide elements 5. Incidentally, unless otherwise stated, in this description, the term "light beam" implies visible light. Each of the light control elements provided at the intersections 7 of the scanning line 4 and the light guide elements 5 is constituted of, as will be described later, for example, an element which is closed or opened by electrostatic force generated between the scanning line 4 and the light guide element 5, or a piezoelectric element driven by a voltage applied to the scanning line 4. If the light guide element 5 is constituted of an optical fiber, a part of the clad of the light guide element 5 corresponding to the intersection 7 is removed, the light beam is led from the core part of the light guide element 5 which corresponds to the intersection 7 to the display surface side by the action given from the piezoelectric element to the light guide element 5. Accordingly, the part of the light guide element 5 corresponding to the intersection 7 corresponds to the light spot (pixel) on the display surface 8, and the light beam is selectively lead from the light spot corresponding to the intersection to the display surface side, thereby displaying an image or a pattern on the display surface 8.

On one end face of the light guide element 5, a plurality of light source modules 1 for generating light beams and guiding the light beams to the light guide elements 5 are arranged. The light source modules 1 includes a large number of light-emitting elements 2 provided to correspond to the large number of light guide elements 5, for example, semiconductor lasers or semiconductor LEDs, and each light-emitting element 2 is provided with a light introduction part 3 for guiding a light beam generated from the light-emitting element 2, for example, a rod lens provided between the light-emitting element 2 and the end face of the light guide element 5. Accordingly, the light beam generated from each light-emitting element 2 is converged by the light introduction part 3, and is introduced into the light guide element 5 from an end face of a corresponding light guide element 5.

A light source control unit 9 which independently controls light emission of each light-emitting element 2 of the light source module 1 is arranged on one end face side of the light guide elements 5. This light source control unit 9 separately supplies a light emission control signal to each light-emitting element 2 to thereby cause the light-emitting element 2 to emit light. Accordingly, if a light control element, i.e., a piezoelectric element is operated, which is provided under the light guide element 5 into which a light beam from the light-emitting element 2 is introduced, the light beam is extracted from the intersection 7 at which the light control element is provided to the outside.

Figure 2:
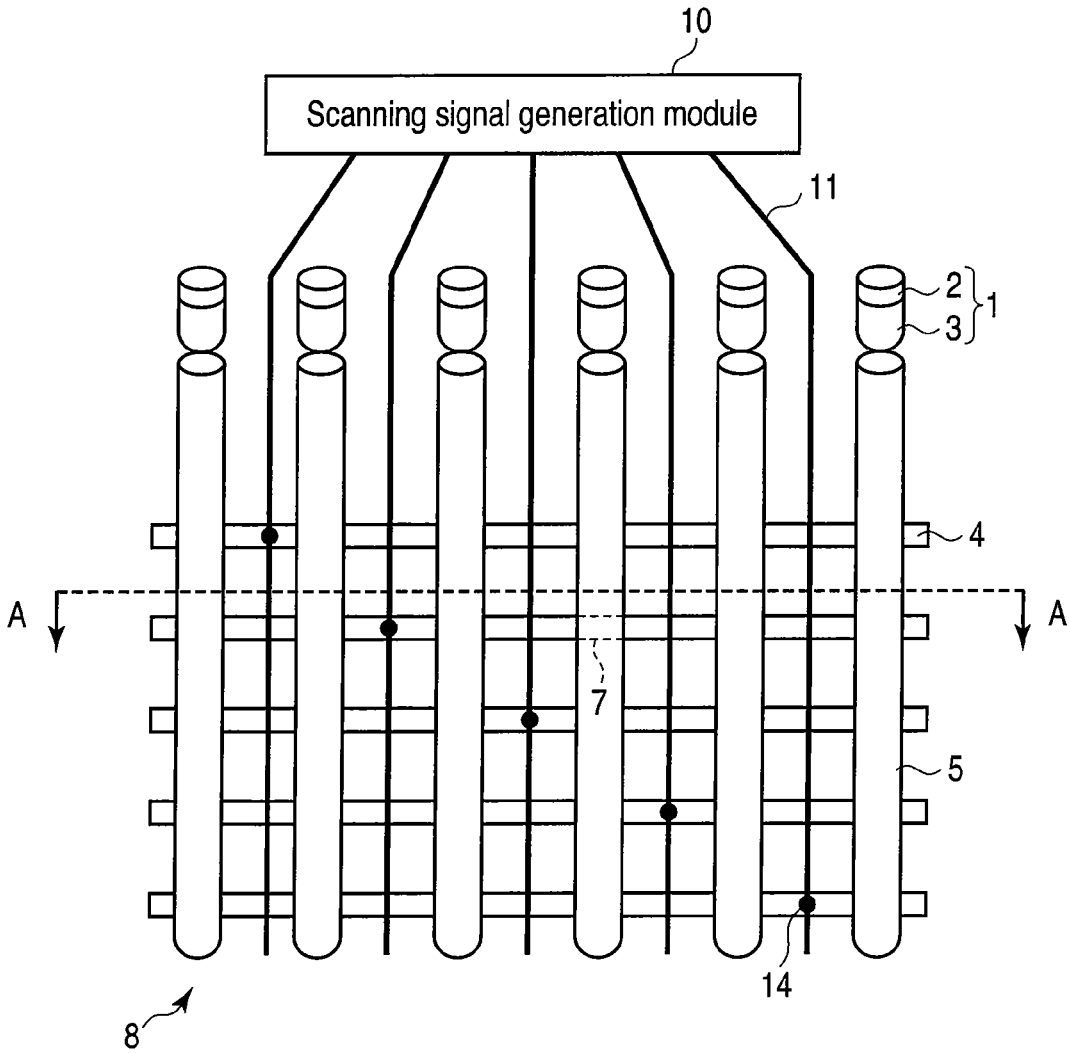
FIG. 2 is a block diagram schematically showing the display apparatus shown in FIG. 1 with enlarging a display surface of the display apparatus.

As shown in FIG. 2, a light scanning signal generation module 10 is further provided at a side of the one end of the light guide elements 5, and a scanning signal is supplied from the light scanning signal generation module 10 to each scanning line 4. A number of scanning signal transmission lines 11 are extended from the light scanning signal generation module 10 along the light guide elements 5 as auxiliary lines, and each of the transmission lines 11 is connected to a corresponding scanning line 4 at a connection point 14. Here, it is desirable that the scanning signal transmission line 11 is also provided with flexibility which does not hinder the flexibility of the light guide element 5, and it is further desirable that the scanning signal transmission line 11 is provided with flexibility which enables the display surface 8 not to be broken even when the display surface 8 is wound up. As shown in FIG. 2, one scanning signal transmission line 11 is connected to one corresponding scanning line 4 at one connection point 14, and hence when a scanning signal is supplied from the light scanning signal generation module 10 to the scanning signal transmission line 11, the scanning signal is supplied to the scanning line 4 connected to this scanning signal transmission line 11. Accordingly, only the light control element connected to the scanning line 4 to which the scanning signal is supplied, i.e., only the piezoelectric element is operated, and the light beam is taken out from the intersection 7 to the outside as described above.

Incidentally, it is to be noted that in FIG. 1, although the same number of scanning signal transmission lines 11 as the number of the scanning lines 4 are extended from the light scanning signal generation module 10, the scanning signal transmission lines 11 are omitted in FIG. 1 to avoid complication of the drawing, and the scanning signal transmission lines 11 are shown in FIG. 2 in which a part of FIG. 1 is enlarged. Further, it is to be noted that in FIG. 2, the light source control unit 9 shown in FIG. 1 is omitted for the sake of simplification of the drawing.

The light source control unit 9 and the light scanning signal generation module 10 may be configured by arranging circuit elements on a board having rigidity as in an ordinary circuit, or may be formed on a flexible board to impart flexibility thereto.

Figure 3:
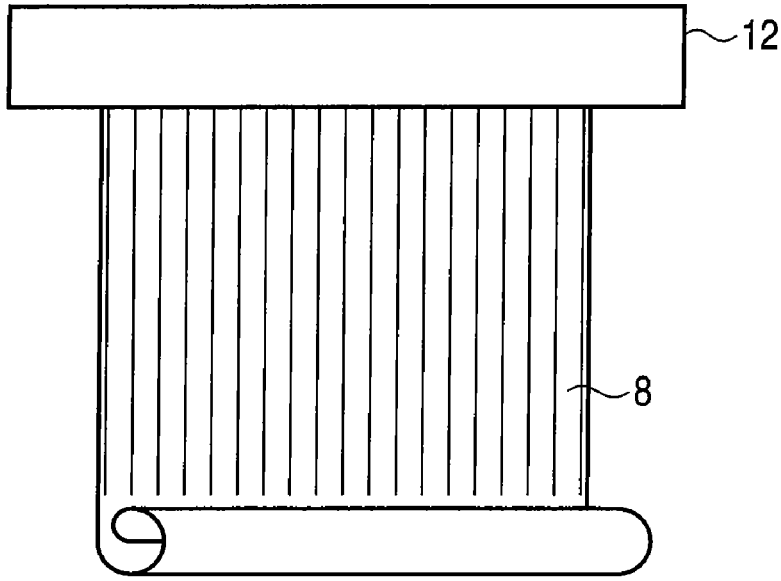
FIG. 3 is a schematic view showing an example of the usage state of the display apparatus shown in FIG. 1.
Figure 4:
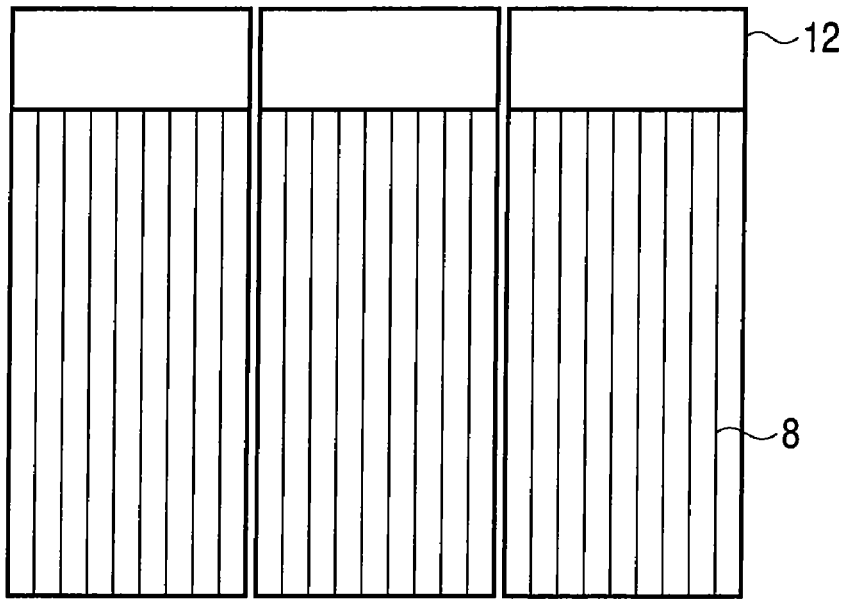
FIG. 4 is a schematic view showing another example of the usage state of the display apparatus shown in FIG. 1.

As described above, in the display apparatus shown in FIGS. 1 and 2, the display surface 8 is provided with flexibility, and hence it is possible, as shown in FIG. 3, to fix a housing part 12 in which the light source control unit 9 and the light scanning signal generation module 10 are contained to a ceiling or the like of a wall of a room, and arrange the display surface 8 on the wall surface in a state where the display surface 8 hangs from the housing part 12. Further, it becomes possible to, when the display apparatus is not in use, wind up the display surface 8, and store the display surface 8 in a storage space in the housing part 12 to thereby utilize the wall surface effectively. Further, in each display apparatus, only the housing part 12 is provided on one end face side of the display surface 8, and circuit sections such as the light source control unit 9, the light scanning signal generation module 10, and the like are not provided on the other side surface, and hence it is possible to prepare a plurality of display apparatuses, and tile the wall surface by using the plural display apparatuses as shown in FIG. 4. In the arrangement shown in FIG. 4, it is possible to arrange the plural display surfaces 8 almost without a gap on the wall, and hence it is possible to form a continuous wide display area by using the plural display apparatuses, and display an image without any uncomfortable feeling on continuous display surfaces 8.

The scanning signal transmission lines 11 shown in FIG. 2 may be extended from the scanning signal generation module 10 along the entire length of the light guide elements 5, or may be extended only to the connection points 14 to be connected to this connection point 14. Further, if the scanning signal transmission lines 11 are visually confirmed, it is desirable, from the viewpoint of giving uniformity to the image, that the scanning signal transmission lines 11 be uniformly arranged in the display surface 8. Here, the term "lack of uniformity" implies that the lengths of the scanning signal transmission lines 11 in the display surface 8 are different from each other, or the insertion intervals of the scanning signal transmission lines 11 or the numbers of inserted lines are different, and unevenness in brightness resulting from the scanning signal transmission lines 11 is caused in the display surface 8. Accordingly, the term "uniformity" implies the state where unevenness in brightness resulting from the lengths of the scanning signal transmission lines 11, the insertion intervals or the like in the display surface 8 is not caused so that the above problem can be avoided.

Figure 5:
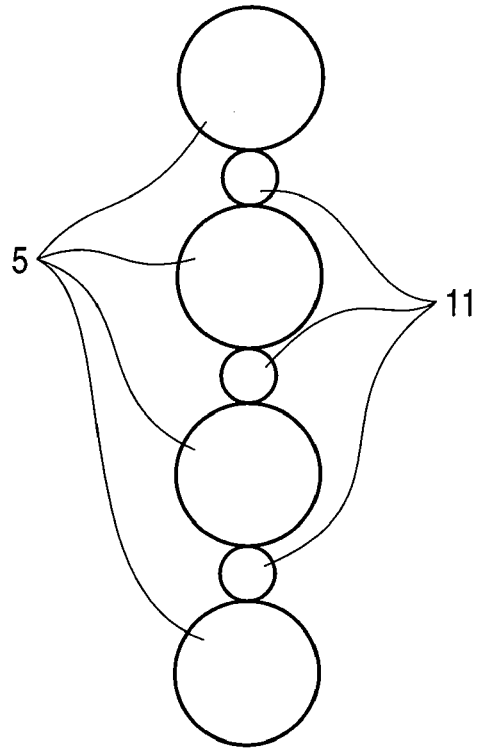
FIG. 5 is a cross-sectional view showing an example of the cross section of the display surface taken along a line A-A shown in FIG. 2.

FIG. 5 is a cross-sectional view showing an example of the cross section taken along line A-A of the display surface shown in FIG. 2. As shown in FIG. 5, it is sufficient if the scanning signal transmission lines 11 are arranged in the gaps between the light guide elements 5 arranged in parallel with each other, and the display characteristics of the display can be prevented from being lowered by this arrangement. If a material transmitting no light beam such as metal is used as the scanning signal transmission lines 11, it is possible to add a function of a black stripe for optically separating the light guide elements 5 from each other to the scanning signal transmission lines 11, and the display image quality is improved.

Figure 6:
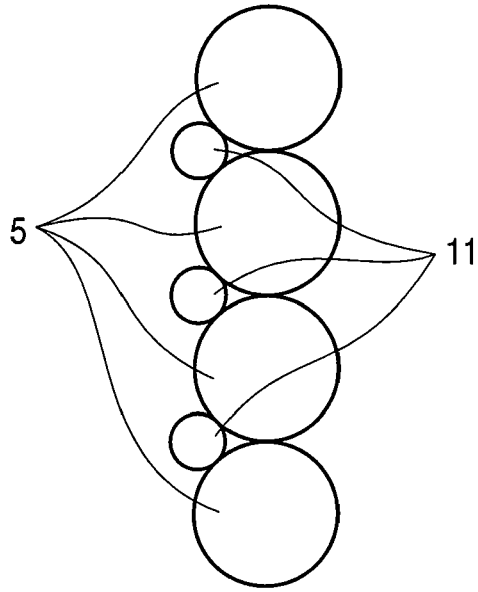
FIG. 6 is a cross-sectional view showing another example of the cross section of the display surface taken along line A-A shown in FIG. 2.

If the light guide element 5 is an optical fiber having a circular cross-sectional shape, it is possible to, in the light guide elements 5 arranged in parallel with each other as shown in FIG. 6, arrange the scanning signal transmission lines 11 in gaps formed between adjacent light guide elements 5. According to such an arrangement, it is possible to arrange the light guide elements 5 in close contact with each other or sufficiently close to each other. As a result, it is possible to further increase the light taking-out area of the display surface 8. If the scanning signal transmission lines 11 are made of a material transmitting no light beam such as metal, and the scanning signal transmission lines 11 are arranged on the front surface side of the display surface 8, it is possible to impart a function of a black stripe for optically separating the light guide elements 5 from each other to the scanning signal transmission lines 11. Further, if the scanning signal transmission lines 11 are made of a material transmitting no light beam such as metal, and the scanning signal transmission lines 11 are arranged in the gaps on the back surface side of the display surface 8, it is possible to obtain an advantage that the light taking-out area on the display surface is not sacrificed.

Figure 7:
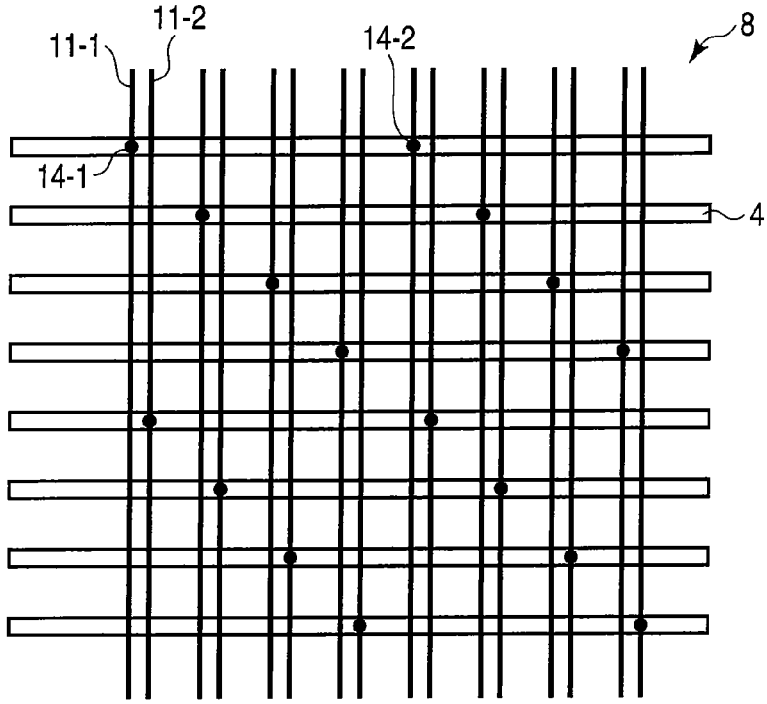
FIG. 7 is a plan view schematically showing a modification example of the display surface of the display apparatus shown in FIG. 2.

Further, as shown in FIG. 7, it is evident that the plurality of scanning signal transmission lines 11 extended along the light guide elements 5 (not shown in FIG. 7 for the sake of simplification of the drawing) may be connected to one scanning line 4 at a plurality of positions 14-1 and 14-2. The scanning line 4 is connected to the plural scanning signal transmission lines 11, and hence it is possible to, even when the electrical resistance of the scanning line 4 becomes large in a display apparatus having a large display surface 8, avoid the problem of the increased electrical resistance by increasing the number of power feeding points 14-1 and 14-2 for the scanning line 4. Further, this enables the scanning signal transmission line 11 to have redundancy, and hence it is possible to obtain an advantage that a manufacturing yield of the display apparatus is improved.

As described above, according to the display apparatus of the embodiment, it is possible to provide a display apparatus which, even when the display surfaces are juxtaposed, does not form non-display areas in which no images are displayed between the display surfaces. Further, it becomes possible to arrange circuit sections such as a light source unit, scanning signal generation module, light source control unit, and the like only on one side of the display surface. As a result of this, it becomes possible to realize a display apparatus excellent in storability, and expandability, such as a flexible display surface utilizing flexibility of the display surface, and tiling of a plurality of display surfaces.

Various examples of the display apparatus of the present invention will be described below more specifically.

EXAMPLE 1

As an example of a linear structure body which is one of the constituent elements in the embodiments, a row direction line 22 is used in this example.

Figure 8:
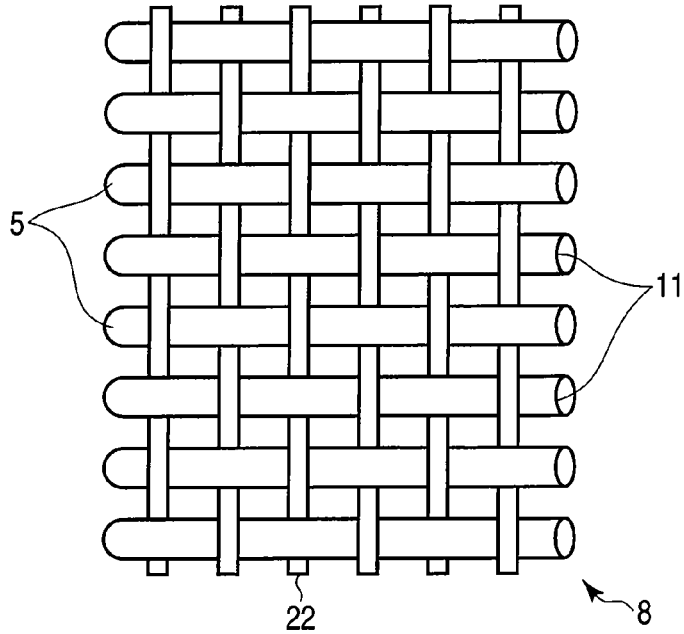
FIG. 8 is a plan view schematically showing a display surface of a display apparatus according to Example 1 of the present invention.

As shown in FIG. 8, light guide elements 5 constituted of plastic optical fibers, and scanning signal transmission lines 11 in which copper wires are coated with a resin are arranged in one of the column (longitudinal) direction and the row (lateral) direction. In the arrangement shown in FIG. 8, the light guide elements 5 are extended in the column (longitudinal) direction, and arranged in the row (lateral) direction, and the scanning signal transmission lines 11 are extended along the light guide elements 5. Further, belt-like fiber members having flexibility are arranged as row (lateral) direction lines 22, and the fiber members are arranged plain-woven with respect to the light guide elements 5 and the scanning signal transmission lines 11 to thereby form the display surface. The fiber members of the lateral (row) direction lines 22 can be made of synthetic fibers such as nylon, polyester, and the like, and metallic fibers in addition to cotton yarn, silk yarn, and the like.

If the scanning signal transmission lines 11 are formed of a material transmitting no light beam, it is possible to optically separate the light guide elements 5 by the scanning signal transmission lines 11. Accordingly, the scanning signal transmission lines 11 can impart a function of a black stripe for preventing mixture of light beams between the light guide elements 5 to the display surface, and high image quality of the display surface can be easily realized.

After the display structure shown in FIG. 8 is formed, light control elements 7 are attached to the back of the display structure shown in FIG. 8, scanning lines 4 in electrical contact with the light control elements 7 are separately formed, and the scanning lines 4 are connected to the corresponding scanning signal transmission lines 11, thereby forming the display surface 8.

EXAMPLE 2

As an example of a linear structure body which is one of the constituent elements in the embodiments, a row direction line 22 is used in this example.

Figure 9:
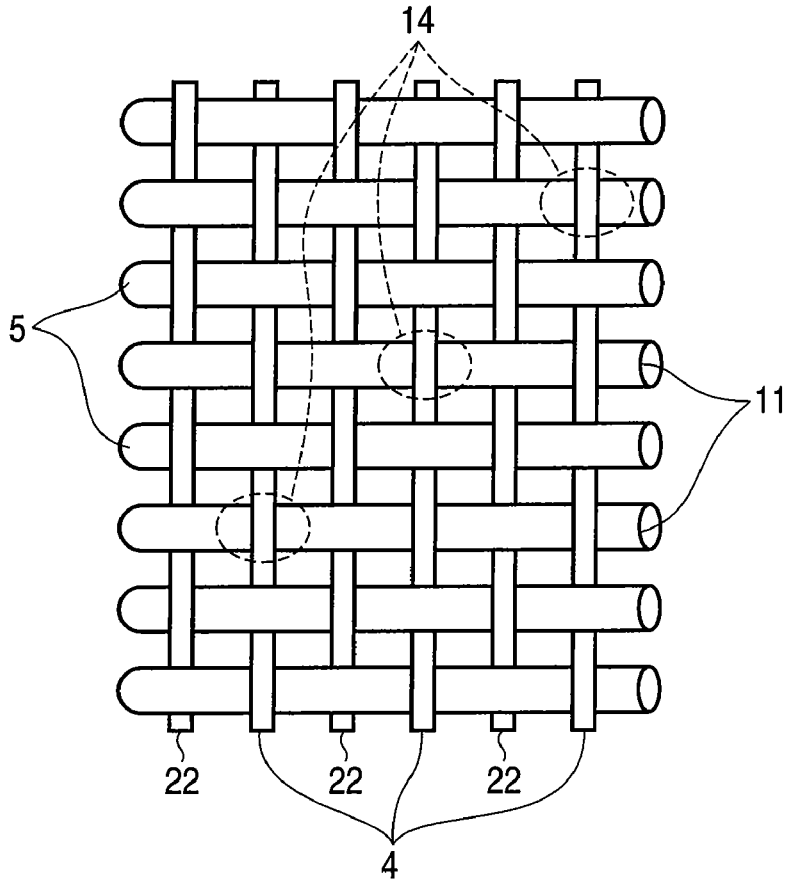
FIG. 9 is a plan view schematically showing a display surface of a display apparatus according to Example 2 of the present invention.

In Example 2 shown in FIG. 9, light guide elements 5 and scanning signal transmission lines 11 extended in the column (longitudinal) direction are alternately arranged in the row (lateral) direction. A polymer fiber having flexibility is used as row (lateral) direction lines 22, and the scanning signal transmission lines 11 and the light guide elements 5 are woven into a plain-woven form, whereby the display surface 8 is formed. As the lateral direction lines 22, synthetic fibers such as nylon, polyester, and the like, metallic fibers, and transparent resin fibers coated with a transparent conductive film, and the like can be used in addition to cotton yarn, silk yarn, and the like. Further, if a part of the row (lateral) direction lines 22 is made the scanning lines 4, it is possible to weave belt-like scanning lines 4 into the plain-woven arrangement. The scanning lines 4 and the scanning signal transmission lines 11 are electrically connected to each other at connection points 14 in the plain-woven arrangement. Further, if the row (lateral) direction lines 22 are made of a material transmitting no light beam, different scanning lines 4 are optically separated from each other, and it is easily possible to constitute a black matrix for separating light beams in units of pixels by the row (lateral) direction lines 22 and the scanning signal transmission lines 11.

Figure 10:
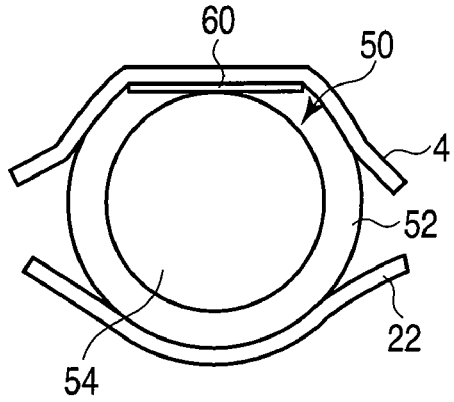
FIG. 10 is a cross-sectional view and a side view showing the structure of the display surface shown in FIG. 9.

In the optical fiber used in the light guide element 5, a part of a clad layer 52 of the optical fiber 50 is removed in the longitudinal direction (extension direction) of the optical fiber, and a part of a core 54 covered with the clad layer 52 is exposed as shown in FIG. 10. Further, an ITO film as a transparent conductive film 60 is formed on the exposed surface of the core 54 formed by removing the clad layer 52 by sputtering. As shown in FIG. 9, the scanning lines 4 are woven in the same direction as the lateral direction lines 22 in terms of the structure, and the scanning lines 4 and the lateral direction lines 22 are alternately arranged in terms of the arrangement. However, the arrangement is not limited to this. The scanning lines 4 need to be provided with conductivity, and metallic fibers, a material prepared by covering a insulating core with metal or a transparent conductive material, and the like can be used for the scanning lines 4.

Here, as the scanning line 4, a film having a long belt-like shape obtained by coating a PET film having a thickness of 20 μm with an ITO film is used, and the scanning line 4 is brought into electro-mechanical contact with the transparent conductive film 60. In the scanning line 4, the surface of the PET film opposite to the surface coated with the ITO film is roughened by a blast treatment, and can scatter the light beam.

In the structure shown in FIG. 10, in a state where the display apparatus is not driven, the light guide elements 5 and the scanning lines 4 are in extremely loose contact with each other, and hence a light beam is prevented from leaking out of the light guide elements 5. Here, the transparent conductive film 60 formed on the light guide element 5 is set at a reference potential. When the display apparatus is driven, the potential of a selected scanning line 4 becomes high, electrostatic force is generated between the light guide element 5 and the scanning line 4, and the scanning line 4 is brought into tight contact with the light guide element 5. As a result of this, the PET film of the scanning line 4 subjected to the blast treatment is strongly pressed against the light guide element 5, a part of the light beam propagated through the light guide element 5 leaks out to the PET film of the scanning line 4, is scattered by the blast-roughened surface, and is released in the direction perpendicular to the substrate.

As for the intensity of a light beam output from each light guide element 5, light emission from the light-emitting element 2 is controlled by the light source control unit 9 in accordance with the timing, and the intensity is adjusted in accordance with the light beam incident on each light guide element 5. That is, the emission intensity of a light-emitting diode corresponding to each light guide element 5 is independently controlled at a timing at which a scanning signal is supplied to the scanning line 4.

If the scanning signal transmission line 11 is made of a material transmitting no light beam, the light guide elements 5 can be optically separated from each other, and hence the scanning signal transmission line 11 can be provided with a function of the black stripe for preventing mixture of light beams between light guide elements 5, and high image quality of display can be easily realized. Further, when the lateral direction line 22 is also made of a material transmitting no light beam, pixels along the light guide elements 5 can be optically separated from each other, and a black matrix for preventing mixture of light beams between pixels can be formed.

Further, if the scanning line 4 is made of a material transmitting no light beam, different scanning lines can be optically separated from each other, and hence the black matrix for separating light in units of pixels can easily be formed in cooperation with the scanning signal transmission lines 11.

EXAMPLE 3

Figure 11A:
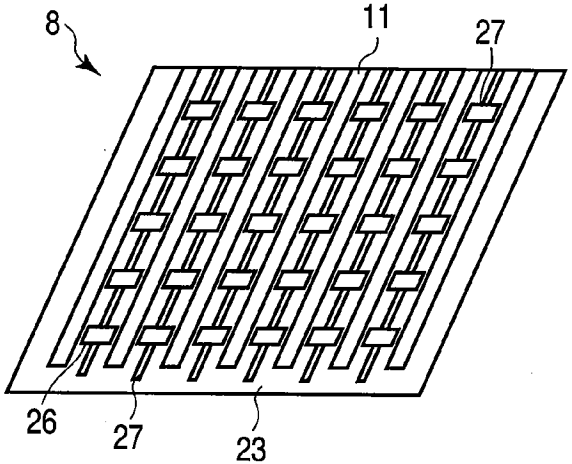
FIGS. 11A, 11B, and 11C are perspective views each schematically showing a manufacturing step of a display surface of a display apparatus according to Example 3 of the present invention.
Figure 11C:
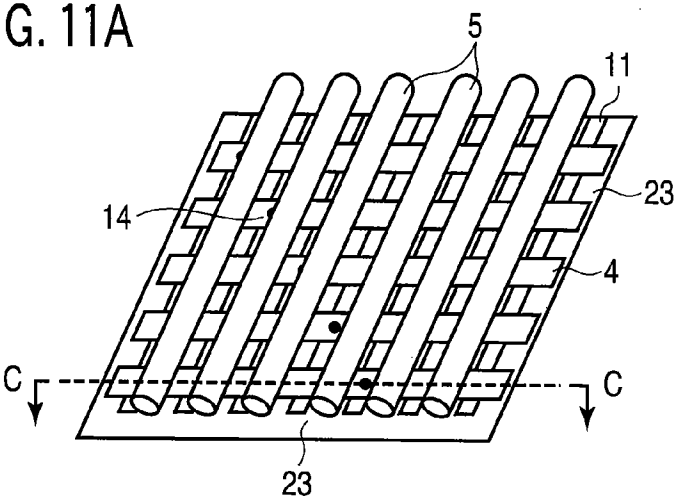
Figure 11B:
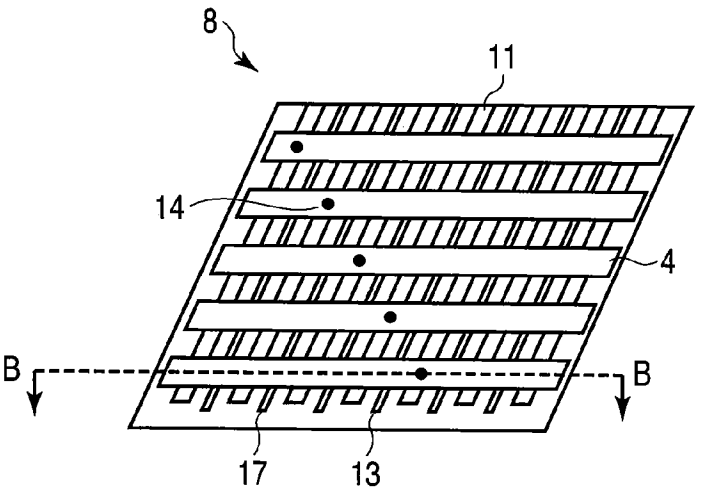

In FIGS. 11A to 11C, manufacturing steps of a display surface 8 according to Example 3 are shown. Further, in FIGS. 12A and 12B, a cross section taken along line B-B shown in FIG. 11B, and a cross section taken along line C-C shown in FIG. 11C are shown.

In the manufacture of the display surface 8, first, preferably, an insulating material having flexibility, for example, a substrate 23 made of flexible plastic is prepared, and Al (aluminum) is deposited on the substrate 23 in a thickness of 1 μm. As shown in FIGS. 11A and 12A, this Al-deposited film is patterned in the column direction, and common electrodes 27 are formed on the substrate 23. Thereafter, scanning signal transmission lines 11 are formed by copper plating. The plural scanning signal transmission lines 11 are formed in such a manner that the lines 11 are extended in the column direction on the substrate 23, and arranged in the row direction. In this formation step of the scanning signal transmission lines 11, the scanning signal transmission lines 11 are formed in such a manner that the lines 11 have a large thickness (corresponding to the distance from the substrate 23 to the connection point 14, i.e., the height in the structure shown in FIGS. 12A and 12B) of 400 μm, and unevenness is formed on the surface of the substrate 23.

Further, on the common electrode 27, a crystal piece of a piezoelectric body 26 (PZT) is stuck to a position (corresponding to the connection point 14) corresponding to the pixel as a light control element 7, and the piezoelectric bodies 26 are arranged in rows and columns, i.e., in a matrix form on the substrate 23, and are electrically connected to the common electrodes 27. The scanning signal transmission lines 11, the common electrodes 27, and the piezoelectric bodies 16 which are arranged on the substrate 23 are covered with an insulating film 25 as shown in FIG. 12A. As the insulating film 25, for example, a polyimide film having a thickness of 30 μm is used, and this polyimide film is stuck to the scanning signal transmission lines 11, the common electrodes 27, and the piezoelectric bodies 16 which are arranged on the substrate 23.

As shown in FIG. 11B, the scanning lines 4 are formed on this insulating film 25 perpendicular to the scanning signal transmission lines 11, conductor terminals penetrating the insulating film 25 are provided at intersections of the scanning signal transmission lines 11 and the scanning lines 4, and the conductor terminals are defined as the connection points 14. Here, the scanning lines 4 are formed perpendicular to the scanning signal transmission lines 11 by a screen printing process using a silver paste. At the intersections of the scanning signal transmission lines 11 and the scanning lines 4, through-holes formed by removing the polyimide layer by laser ablation are provided before the printing, and the scanning signal transmission lines 11 and the scanning lines 4 are electrically connected to each other through the conductors of the connection points 14.

Figure 12B:
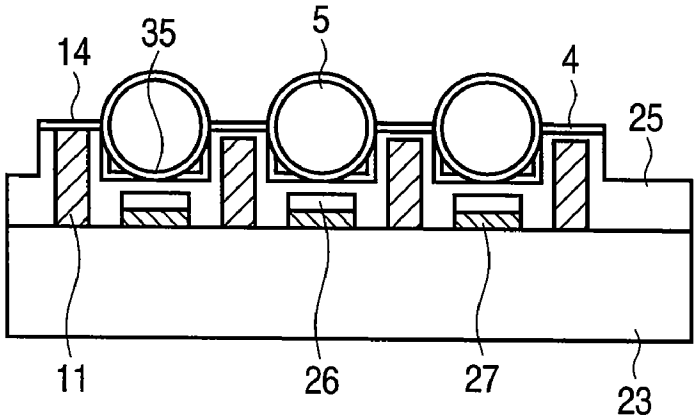
FIGS. 12A and 12B are a cross-sectional view taken along line B-B shown in FIG. 11B, and a cross-sectional view taken along line C-C shown in FIG. 11C.
Figure 12A:
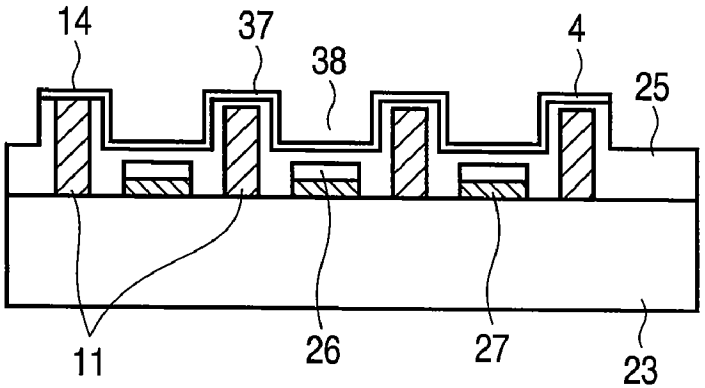

Subsequently, as shown in FIGS. 11C and 12B, a display surface in which a plurality of light guide elements 5 are arranged in parallel with each other on the insulating film 25 along the scanning signal transmission lines 11 on the substrate 23, and the scanning signal transmission lines 11 are formed in the same direction as the light guide elements 5 is easily manufactured. Here, in an example, a plastic optical fiber having a diameter of 1 mm is used as the light guide element 5, the optical fiber has a part 35 corresponding to a pixel and, at this pixel part 35, the clad layer is partly removed at the surface thereof opposed to the substrate 23. This light guide element 5 is stuck to the insulating film 25 other than the pixel part 35 to be formed on the display surface 8.

As shown in FIG. 12A, if the plural scanning signal transmission lines 11 are formed on the substrate 23, a sufficient height is given to the scanning signal transmission lines 11, and hence unevenness is formed on the surface of the substrate. Then, the insulating film 25 is formed and, thereafter, the scanning lines 4 are formed on the insulating film 25. Accordingly, on the insulating film 25, convex sections 37 along the scanning signal transmission lines 11, and concave sections 38 between the convex sections 37 are formed. That is, the convex sections 37 are so formed as elongated projections on the substrate 23 and elongated spaces are defined as the concave sections 38 between the elongated projections. As shown in FIG. 12B, the light guide elements 5 are arranged and fixed so that the structures 5 can be received in the concave sections 38. In this way, the light guide elements 5 are positioned on the substrate 23 in a self-aligning manner, and hence even when the area of the display surface becomes large, it becomes possible to easily manufacture the display surface.

Incidentally, it is desirable that the height of the convex section 37 be equal to or larger than one fourth of the diameter of the light guide element. If the height of the convex section 37 becomes higher, the self-alignment is enhanced higher, the light mixture between light guide elements 5 is more suppressed, and the function thereof as the black stripe is more improved.

The piezoelectric body 26 provided on the substrate 23 shown in FIG. 12B is expanded/contracted in the direction perpendicular to the substrate 23 by an electric field generated between the common electrode 27 and the selected scanning line 4. As described above, the light guide element 5 includes the pixel part 35 formed by partly removing the side surface thereof, and the contact pressure applied from the scanning line 4 to the pixel part 35 is changed concomitantly with the expansion/contraction of the piezoelectric body 26. When the pixel part 35 and the scanning line 4 are brought into contact with each other at high pressure, the silver paste layer of the scanning line 4 is brought into tight contact with the part 35 at which the clad layer of the light guide element 5 is removed. Accordingly, a part of the light beam propagated through the light guide element 5 collides against the silver paste layer at the contact part, and the collided light beam is strongly reflected to be scattered in the direction perpendicular to the substrate 23. As a result of this, the light beam is directed from the pixel part 35 toward the outside of the display surface 8, and the pixel part is displayed as a light spot.

The display structure shown in FIGS. 11C and 12B is driven in the following manner. When the scanning line 4 is not selected, the scanning line 4 is maintained at the same potential as the electrode potential of the common electrode 27 opposed to the scanning line 4. When the scanning line 4 is selected, a voltage is applied to an arbitrary scanning line 4 in order that a potential different from the potential of the common electrode 27 may be given to the scanning line 4. Accordingly, an electric field is generated between the common electrode 27 and the scanning line 4, this electric field is applied to the piezoelectric body 26, and the piezoelectric body 26 is expanded to be strongly pressed against the side surface of the light guide element 5. As a result of this, as described above, the silver paste layer of the scanning line 4 is strongly pressed against the scanning line 4, and the light beam is strongly scattered from a pixel (pixel part 35) of a row corresponding to the scanning line 4.

The intensity of the light beam output from each light guide element 5 is adjusted in accordance with the intensity of the light beam incident on each light guide element 5. For example, when a light-emitting diode is provided for each light guide element 5 as a light source, the light source control unit 9 controls the light emission of the light-emitting diode in accordance with the timing of the scanning signal of the scanning line 4. By this light source control unit 9, the emission intensity of each light-emitting diode is independently controlled, and the intensity of light derived from the pixel part 35 is adjusted. Accordingly, on the display surface 8, an image is displayed at the light intensity corresponding to the image to be displayed, and a clear image is displayed on the display surface 8.

Incidentally, in Example 2 shown in FIGS. 11A to 12B, the substrate 23 may be an optically-transparent substrate. When the light guide element 5 is transparent with respect to the visible light range, the entire display surface 8 becomes transparent, and it is possible to realize a display method in which an image emerges in a see-through display. Examples of the transparent material include acrylic resins, silicone series resins, norbornene series resins, polycarbonate series resins, nylon resins, polyethylene series resins, polyester series resins, and cyclohexane series resins. Further, the substrate 23 may be a light-absorptive substrate that absorbs light of the visible light range. Light beams output from the light guide elements 5 are free from color mixture, and ambient light can be absorbed, and hence it is possible to provide a display with high contrast and color reproducibility. An example of the material having light absorption is a material obtained by dispersing a pigment represented by carbon black in the above-mentioned transparent material. Further, a material obtained by dispersing fine particles of metal or a semiconductor may be used as the material having light absorption.

Further, as the substrate 23, a substrate having a surface with high reflectance may be used. A light beam scattered from the light guide element 5 to the rearward of the display surface 8 can be efficiently reflected forwardly, and improvement in luminance can be realized. Examples of the material with high light reflectance having high light reflectance in the visible light range include films having metal such as Al, Ag, Pt, Mo, Ta, W, and the like or an alloy as a principal ingredient. Alternatively, a film obtained by applying fine particles constituted of a material having transparency in the visible light range to a substrate, and forming the resultant into a film may also be used. Further, a film obtained by dispersing the above fine particles in a resin transparent in the visible light range may be used. In these cases, light is scattered by the fine particles, and can be reflected toward the front of the display surface 8.

It is advisable to select and optimize the optical characteristics of the substrate 23 as needed in accordance with the use environment and usage of the display.

The present invention is not limited to the examples described above, and can be variously modified and implemented within the scope not deviating from the gist thereof.

For example, although an optical fiber is used as the light guide element 5 in the above examples, the light guide element is not limited to the optical fiber as long as it is a long-sized light guide element, and the cross-sectional shape may be polygonal if only the equivalent optical properties are provided.

As has been described above, according to the embodiment of the invention, it is possible to provide a display apparatus which, even when the display surfaces are juxtaposed, does not form non-display areas in which no images are displayed between the display surfaces. Accordingly, tiling display using a plurality of displays is enabled, and a display apparatus excellent in storability can be provided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A display apparatus comprising:

a display part including a plurality of light guide elements which have end faces, are extended in the column direction, and are arranged in the row direction in parallel with each other;

emitting parts which emits light beams which are directed to the end faces and are introduced into the light guide elements, respectively;

scanning lines extended in the row direction, arranged in the column direction, and intersecting with the light guide elements;

a generation module which generates scanning signals to the scanning lines;

a control unit which controls the emitting parts to control emissions of the light beams from the emitting parts into the light guide elements;

control elements provided at intersections of the light guide elements and the scanning lines, each of which causes a part of the light beam traveled in the light guide element to the outside of the light guide element in response to the scanning signal applied to the control element through the scanning line; and first transmission lines extended along the light guide elements, which connect the scanning lines to the generation module to supply the scanning signals to the scanning lines from the generation module, respectively.

2. The display apparatus according to claim 1, wherein the first transmission lines are arranged in gaps between the light guide elements adjacent to each other.

3. The display apparatus according to claim 2, wherein the transmission line is made of a material which prevents visible light rays from being transmitted.

4. The display apparatus according to claim 1, wherein the display parts further includes linear elements each of which is so extended as to be woven to at least one of the light guide element and the transmission line.

5. The display apparatus according to claim 1, wherein each of the scanning lines is woven to at least one of the light guide element and the transmission line.

6. The display apparatus according to claim 1, wherein the light guide elements are arranged on a substrate on which the first scanning signal first transmission lines are formed.

7. The display apparatus according to claim 6, wherein the first transmission lines are formed into elongated projections extending on the substrate and each of the light guide elements is arranged in concave space between the adjacent elongated projections.

8. The display apparatus according to claim 1, further comprising second transmission lines extended along the light guide elements, connected to the scanning lines, which connects the scanning lines to the generation module, wherein the scanning lines are connected to the first and second transmission lines, respectively.

9. The display apparatus according to claim 1, wherein the scanning lines are connected to the first scanning signal transmission lines, respectively.

* * * * *